US007057523B2

(12) United States Patent
Lin et al.

(10) Patent No.: US 7,057,523 B2
(45) Date of Patent: Jun. 6, 2006

(54) NON-VOLATILE MEMORY DEVICE WITH WIRELESS CONTROL FUNCTION

(75) Inventors: Yu-Chuan Lin, Hsinchu (TW); Chun-Chieh Chen, Tai-Nan (TW); Hung-Ju Shen, Taipei (TW); Chien-Hua Wu, Miao-Li (TW); Sheng-Lin Chiu, Nan-Tou (TW); Huan-Tung Wang, Hsinchu (TW); Hsin-Chih Hung, Yun-Lin (TW)

(73) Assignee: Ritek Corporation, Hsinchu (TW)

( * ) Notice: Subject to any disclaimer, the term of this patent is extended or adjusted under 35 U.S.C. 154(b) by 222 days.

(21) Appl. No.: 10/604,325

(22) Filed: Jul. 11, 2003

(65) Prior Publication Data

US 2004/0183691 A1 Sep. 23, 2004

(30) Foreign Application Priority Data

Jul. 16, 2002 (TW) ..... 91210795 U

(51) Int. Cl.
*G08C 19/00* (2006.01)

(52) U.S. Cl. ..... 340/825.69; 345/1; 348/734

(58) Field of Classification Search ..... 340/825.69, 340/901, 825.17, 717; 348/13, 564, 739, 348/734; 345/1; 434/350; 353/42; 359/142
See application file for complete search history.

(56) References Cited

U.S. PATENT DOCUMENTS 5,307,055 A * 4/1994 Baskin et al. ..... 345/2.2
5,584,554 A * 12/1996 Moore et al. ..... 353/122
5,782,548 A * 7/1998 Miyashita ..... 353/42

* cited by examiner

*Primary Examiner*—Michael Horabik
*Assistant Examiner*—Matsuichiro Shimizu
(74) *Attorney, Agent, or Firm*—Jianq Chyun IP Office

(57) ABSTRACT

A non-volatile memory device with wireless control function which can be divided into two parts comprising a main part and a remote control part. The main part includes a connection port, a memory system and a remote control signal reception module, while the remote control part including a function-key module, a controller, a remote control signal emission module and a power storage unit. The function-key module produces a set of key signals while being pressed, and the controller produces a control signal corresponding to the set of key signals. The remote control signal emission module emits a remote control signal corresponding to the control signal. The remote control signal reception module produces a host control signal corresponding to the remote control signal, and the host control signal is transferred to the host via the connection port to control operations of the host. The power storage unit stores power which is provided to the remote control part while the remote control part is being used.

33 Claims, 7 Drawing Sheets

NON-VOLATILE MEMORY DEVICE WITH WIRELESS CONTROL FUNCTION

CROSS REFERENCE TO RELATED APPLICATIONS

This application claims the priority benefit of Taiwan application serial no.91210795, filed on Jul. 16, 2002.

BACKGROUND OF INVENTION

1. Field of Invention

The present invention generally relates to a not-volatile memory device, and more particularly, to a non-volatile memory with wireless control function.

2. Description of Related Art

In line with the prevalence of electronic products, the storage of digital data has become a frequent operation in daily life. In order to realize the portability of the digital data saved so that it can be applied everywhere, the non-volatile memory, e.g. flash memory, has been developed by some manufacturers and serves as a main part in the non-volatile memory device. This non-volatile memory can be connected to a host via the different kinds of external bus interfaces, e.g. the Universal Serial Bus (USB) interface, RS232 interface or 1394 interface. The external bus is not only used by the non-volatile memory device to exchange data with the main part, but also used by the non-volatile memory device to obtain the power supplied from the host.

Since its characteristics of high portability and ease of connection to all kinds of hosts, the non-volatile memory is widely accepted by users and getting more and more popular now. A common application of the non-volatile memory device is to save the presenting data of sales person, academic researchers or other persons presenting their product's features or research results. However, in the process of the presentation, the person who is in charge the presentation must either assign someone to change the pictures displayed on the screen according to the presentation contents or has to walk around between the projected pictures and the host to change the pictures himself/herself. Either of the above situations causes a great inconvenience to the presenter.

SUMMARY OF INVENTION

To solve the above problem, it is an object of the present invention to provide a non-volatile memory device with wireless control function. The non-volatile memory device with wireless control function is divided into a remote control part and a main part, and a remote control signal sent by the remote control part is transferred to the host via the main part and a bus connected to the host, so that it can be used to control the host. Therefore, the user can perform the presentation under a relaxed atmosphere.

In order to achieve the object mentioned above and others, the present invention provides a non-volatile memory device with wireless control function. The non-volatile memory device comprises a main part and a remote control part. The main part comprises a connection port, a memory system and a remote control signal reception module. The remote control part comprises a function-key module, a controller, a remote control signal emission module and a first power storage unit. The connection port of the main part is electrically connected to a host, and the host provides the data and the host power to the non-volatile memory device with wireless control function via an external bus connected to the connection port. The memory system caches the data received by the connection port, and then writes the cached data into the non-volatile memory. The function-key module produces a set of key signals while being pressed. The controller produces a control signal corresponding to the set of key signals after it is received. The remote control signal emission module emits a corresponding remote control signal according to the control signal. After the remote control signal is received by the remote control signal reception module of the main part, the remote control signal reception module issues a set of host control signals that corresponds to the remote control signal, so that a host control signal can be transferred to the host via the connection port for controlling host operations. Moreover, the first power storage unit included in the remote control part stores power that is provided to the remote control part for its operation.

In a preferred embodiment of the present invention, the connection port comprises an interface connection device that connects to an interface, which can be one of the Universal Serial Bus (USB) interface, 1394 interface, RS232 interface, parallel transmission interface, PCMCIA interface, CF interface, SD interface, MMC interface and Memory Stick interface.

In a preferred embodiment of the present invention, the main part further comprises a second power storage unit. The second power storage unit stores the power that is provided to the main part when the host power is lost. Moreover, the first or the second power storage unit may be either a rechargeable battery or a non-chargeable battery. In a preferred embodiment of the present invention, a charging operation can be performed on the power storage units via the host power provided via the connection port.

The non-volatile memory device with wireless control function provided by the present invention includes a separable remote control part, and a remote control signal can be provided to the main part of a non-volatile memory device with wireless control function via the remote control part. The main part then transfers a control signal that is used for controlling the host via an external bus connected to the host. Therefore, the present invention allows the user to control host operations without to be on-site.

BRIEF DESCRIPTION OF DRAWINGS

The accompanying drawings are included to provide a further understanding of the invention, and are incorporated in and constitute a part of this specification. The drawings illustrate embodiments of the invention, and together with the description, serve to explain the priciples of the invention.

DETAILED DESCRIPTION

Figure 1:
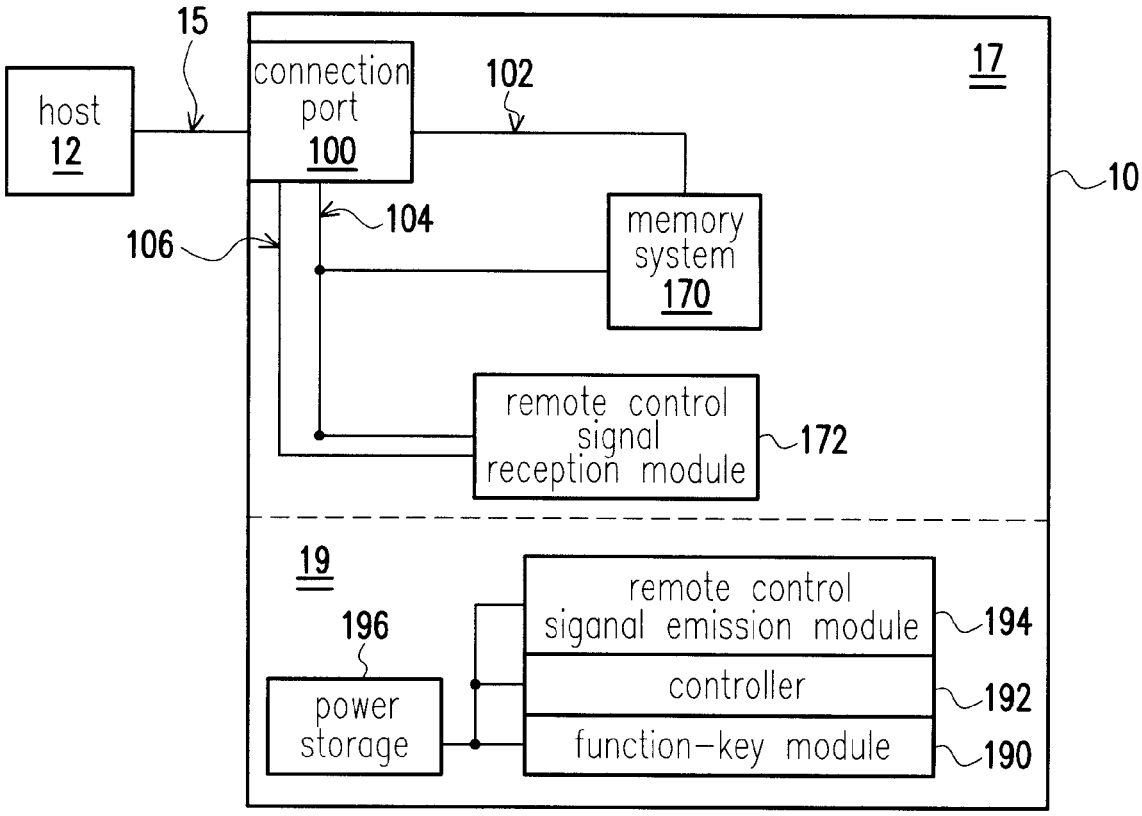
FIG. 1 schematically shows a system block diagram of a preferred embodiment according to the present invention.

FIG. 1 schematically shows a system block diagram of a preferred embodiment according to the present invention. In the present embodiment, the non-volatile memory device with wireless control function 10 comprises a main part 17 and a remote control part 19. These two parts are separated by a dotted line in the diagram. The main part 17 comprises a connection port 100, a memory system 170 and a remote control signal reception module 172. While the remote control part 19 comprises a function-key module 190, a controller 192, a remote control signal emission module 194 and a power storage unit 196 (the parts shown in the diagram is not to scale). The connection port 100 exchanges signals with a host 12 via an external bus 15, and the host 12 not only provides the data to the non-volatile memory device 10, but also provides a host power to the non-volatile memory device 10 for its operation. Herein, the suitable external bus at least comprises the Universal Serial Bus (USB) interface, 1394 interface, serial transmission (RS232) interface, parallel transmission on interface, Personal Computer Memory Card International Association (PCMCIA) interface, Compact Flash (CF) interface, Secure Digital (SD) memory card interface, Multimedia Memory Card (MMC) interface and Memory Stick interface. On the other hand, the connection port 100 must at least include an interface connection device that can connect to one of these interfaces.

Inside the main part 17, the connect port 100 receives the data output from the host 12 via the external bus 15, then the data is transferred to the memory system 170 via the data signal line 102 to perform the data write-in operation. Whereas, when the read operation is being processed, the data is transferred from the memory system 170 to the connection port 100 via the data signal line 102 first, and then transferred to the host 12 via the external bus 15. Moreover, the host power received by the connection port 100 is provided to the memory system 170 and the remote control signal reception module 172 via the power supplying path 104, respectively. The remote control signal reception module 172 transfers the host control signal to the connection port 100 via the data signal line 106, and the host control signal is subsequently transferred to the host 12 via the external bus 15.

Whereas inside the remote control part 19, the function-key module 190 produces a set of key signals corresponding to different function keys that are pressed by the user. Then, the set of key signals is converted to a control signal used for controlling the remote control signal emission module 194 via the controller 192. After the control signal is received, the remote control signal emission module 194 produces a corresponding remote control signal according to a predetermined communication protocol. Furthermore, the whole electric power used by the remote control part 19 is provided by the power storage unit 196, and the power storage unit 196 may be either a rechargeable battery or a non-rechargeable battery.

Figure 2:
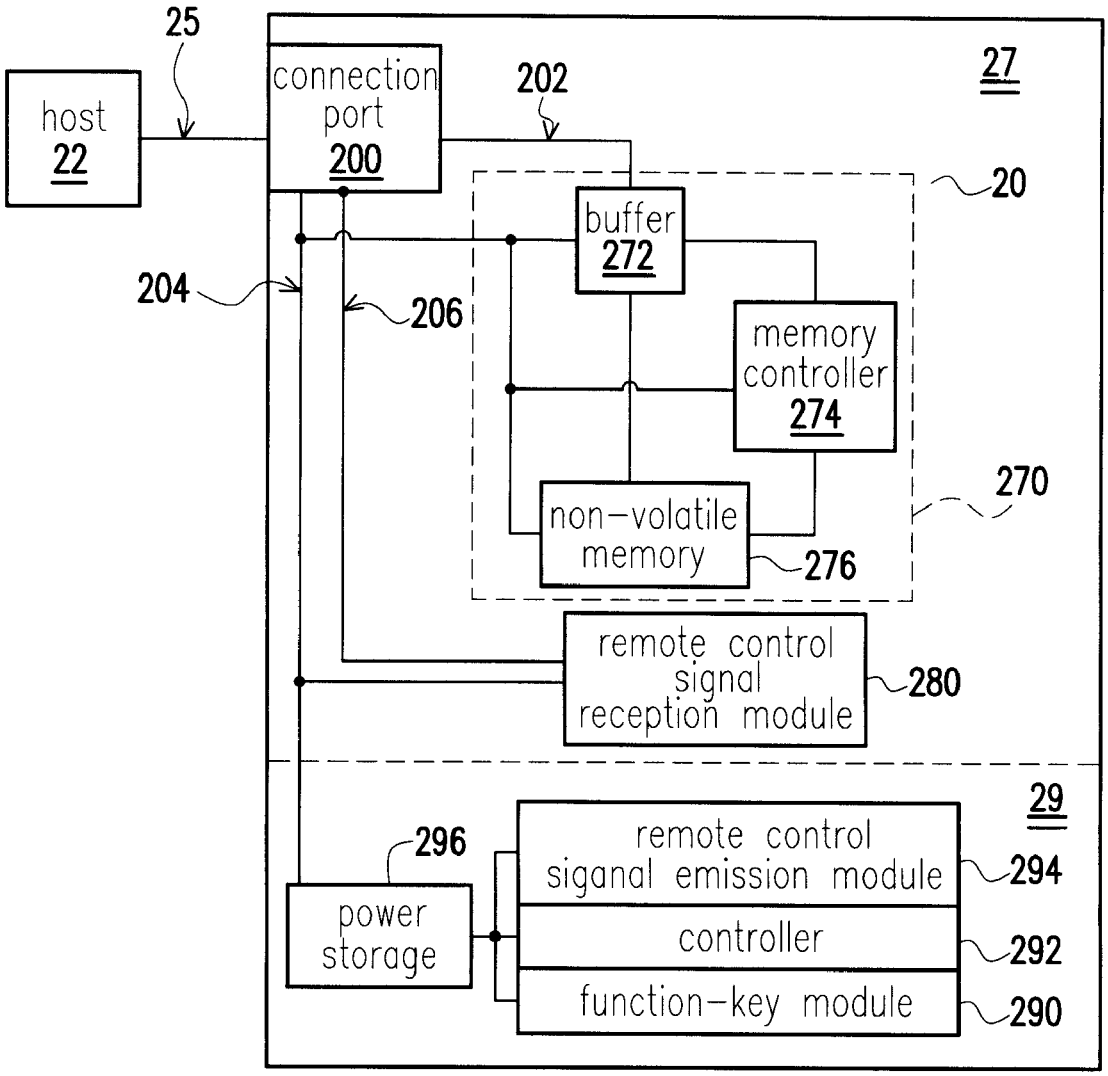
FIG. 2 schematically shows a circuit block diagram of another preferred embodiment according to the present invention.

FIG. 2 schematically shows a circuit block diagram of another preferred embodiment according to the present invention. In the present embodiment, the host power received from the connection port 200 is not only provided to the memory system 270 and the remote control signal reception module 280 in the main part 27, but also provided to the remote part 29 via the power supplying path 204, so as to provide the electric power to the power storage unit 296 for its charging operation. Moreover, the data received by the connection port 200 is cached in the buffer 272 inside the memory system 270 via the data signal line 202, and the memory controller 274 subsequently controls and writes the data in the buffer 272 to the non-volatile memory 276.

Furthermore, after the remote part 29 is separated from the main part 27, since the host power provided via the power supplying path 204 is cut off, the power used by the remote control part 29 is then provided by the power storage unit 296. Based on the assumption that the power storage unit 296 can provide sufficient power that is needed to operate the remote control part 29, when the user presses different keys provided by the function-key module 209, the function-key module 209 produces a set of key signals that corresponds to the key that is pressed. After the controller 292 receives the set of key signals, the set of key signals is converted to a set of corresponding control signals for controlling the remote control signal emission module 294. After receiving the set of control signals, the remote control signal emission module 294 produces a set of remote control signals according to the message delivered by the control signal. After the remote control signal reception module 280 inside the main part 27 receives the remote control signal emitted from the remote control signal reception module 294, a set of host control signals is interpreted according to the set of remote control signals. The set of host control signals is then transmitted back to the connection port 200 via the data signal line 206, so that the host control signal can be transmitted back to the host 22 via the external bus 25 for controlling the operation of host 22.

Figure 3A:
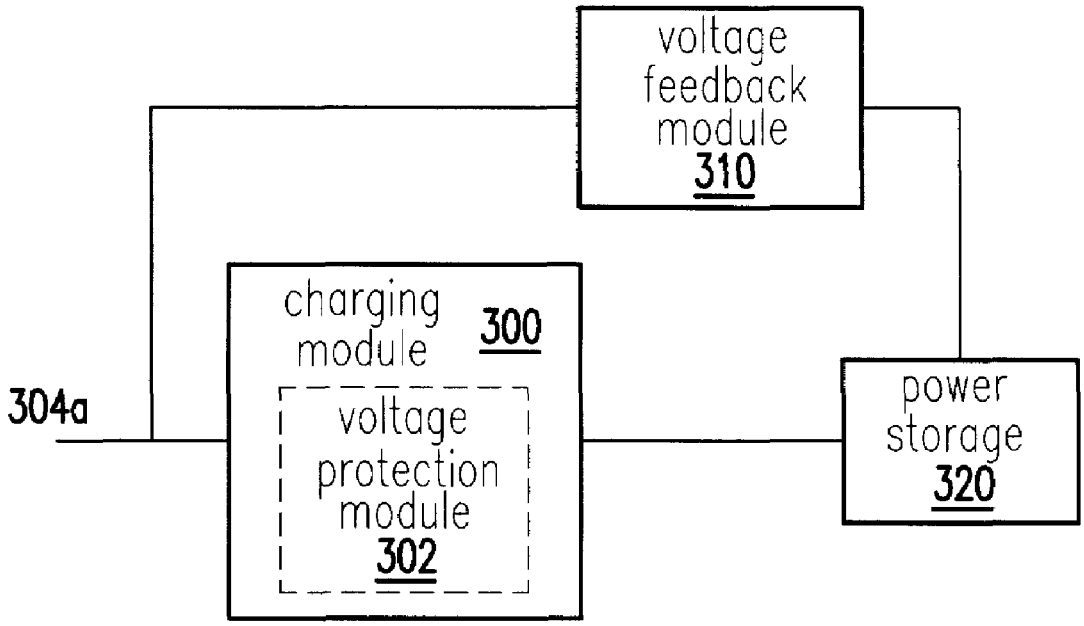
FIG. 3A schematically shows a circuit block diagram of the power part in a preferred embodiment according to the present invention.

In order to immediately provide electric power to the remote control part 29 when the host power is discontinued, a voltage feedback module is adopted in a preferred embodiment of the present invention for detecting a voltage variance happening in the power supplying path 204. FIG. 3A schematically shows a preferred embodiment where the voltage feedback module 310 is used to monitor the voltage variance on the power supplying path 304*a*. In the present embodiment, the charging module 300 uses the power provided via the power supplying path 304*a* to perform the charging operation onto the power storage unit 320. Moreover, in order to prevent the surge generated by the power provided via the power supplying path 304*a* from damaging the power storage unit 320, a voltage protection module 302 is provided in the charging module 300 by the present embodiment. In the present embodiment, when the host power still exists, the host power is provided to the power storage unit 320 via the charging module 300. Whereas, when the host power becomes lower and lower gradually and even is out of the power, since the voltage variance on the power supplying path 304*a* is detected, the power feedback module 310 starts outputting the power provided by the power storage unit 320 to the power supplying path 304*a*.

Figure 3B:
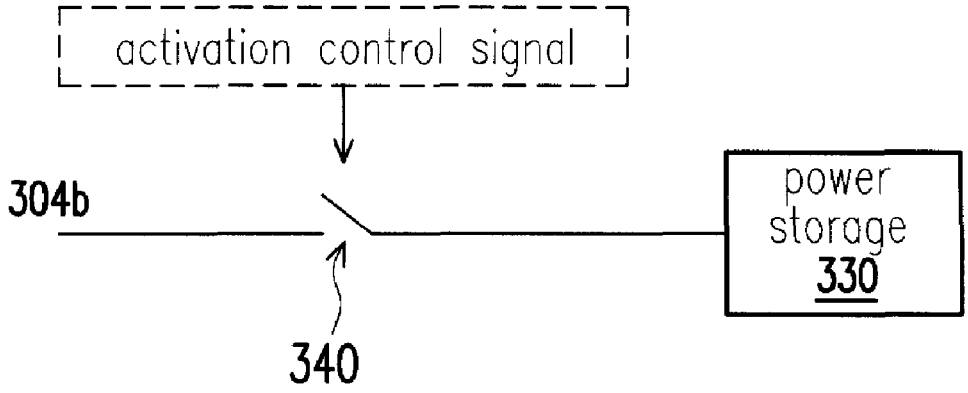
FIG. 3B schematically shows a circuit block diagram of the power part in another preferred embodiment according to the present invention.

Besides the method of the voltage feedback module 310 monitoring the power supplying path 304*a*, there are many other methods for providing power to the power storage unit 320 when it is needed. FIG. 3B schematically shows a circuit block diagram of a preferred embodiment for controlling the power storage unit to provide the power or not. The switch 340 is controlled by an activation control signal to determine whether to turn it on or off, and it also impacts whether the power storage unit 330 provides power or not. Under the situation of a preferred embodiment, whether the activation control signal is issued by the controller 292 as shown in FIG. 2 is determined according to whether the function-key module 290 is pressed or not. Therefore, the power storage unit 330 provides the power stored only when it is needed, so that the effective usage time can be extended.

Since the voltage transmitted via the external bus mentioned above is generally about 5V, thus the memory system, the remote control part, and the power storage unit suitable for the embodiment without the voltage regulator mentioned above also can be operated under the environment of 5V. However, it will be apparent to one of the ordinary skill in the art that the present invention also can be applied to those elements operated under different voltages by adding the voltage regulator to it.

Figure 4:
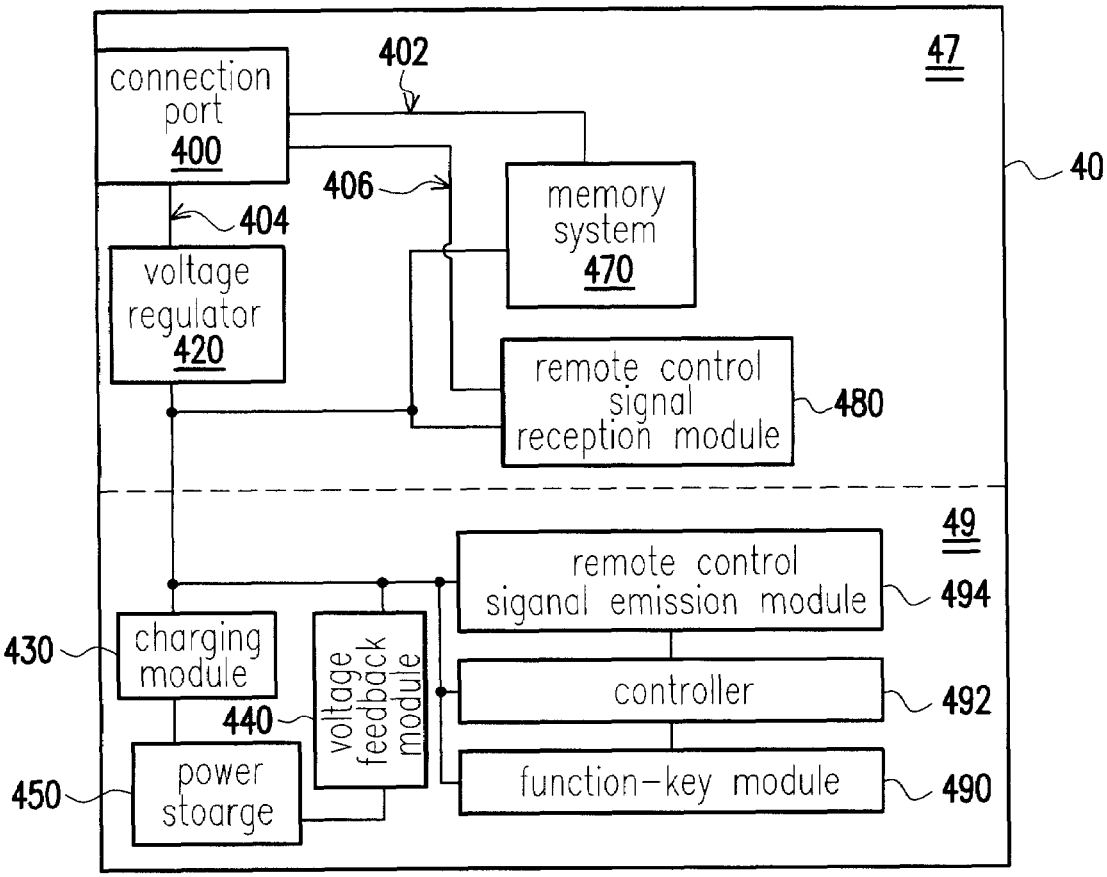
FIG. 4 schematically shows a circuit block diagram of another preferred embodiment according to the present invention.

FIG. 4 schematically shows a circuit block diagram of the embodiment where the voltage regulator is added into the present invention. For simplifying the description, the buffer 272 and the memory controller 274 in FIG. 2 are merged into a memory system 470 in the present embodiment. In the present embodiment, the host power received by the connection port 400 is provided to the voltage regulator 420 first, and the voltage regulator 420 converts the host power to the voltage that is suitable for the operation of the internal elements, e.g. the memory system 470, the remote control signal reception module 480 or the internal elements inside the remote control part 49, after which the converted host power is output to the internal elements, respectively.

However, it will be apparent to one of the ordinary skill in the art that the circuit shown in the embodiment mentioned above does not serve as the necessary and only circuit layout method, and those who are skilled in the related art may modify the circuit design among the concepts mentioned above. Therefore, the embodiment mentioned above is only exemplified herein and is not used to limit the scope of the present invention. In the embodiment of the present invention having the voltage regulator, the internal elements are not limited to having the same potential as the host power transmitted from the external bus, and they can be modified according to the individual cost or circuit consideration.

Preferably, the present invention uses the rechargeable battery so that the energy has better utilization. However, the non-rechargeable battery such as the button-type battery also can be used in the present invention.

Figure 5:
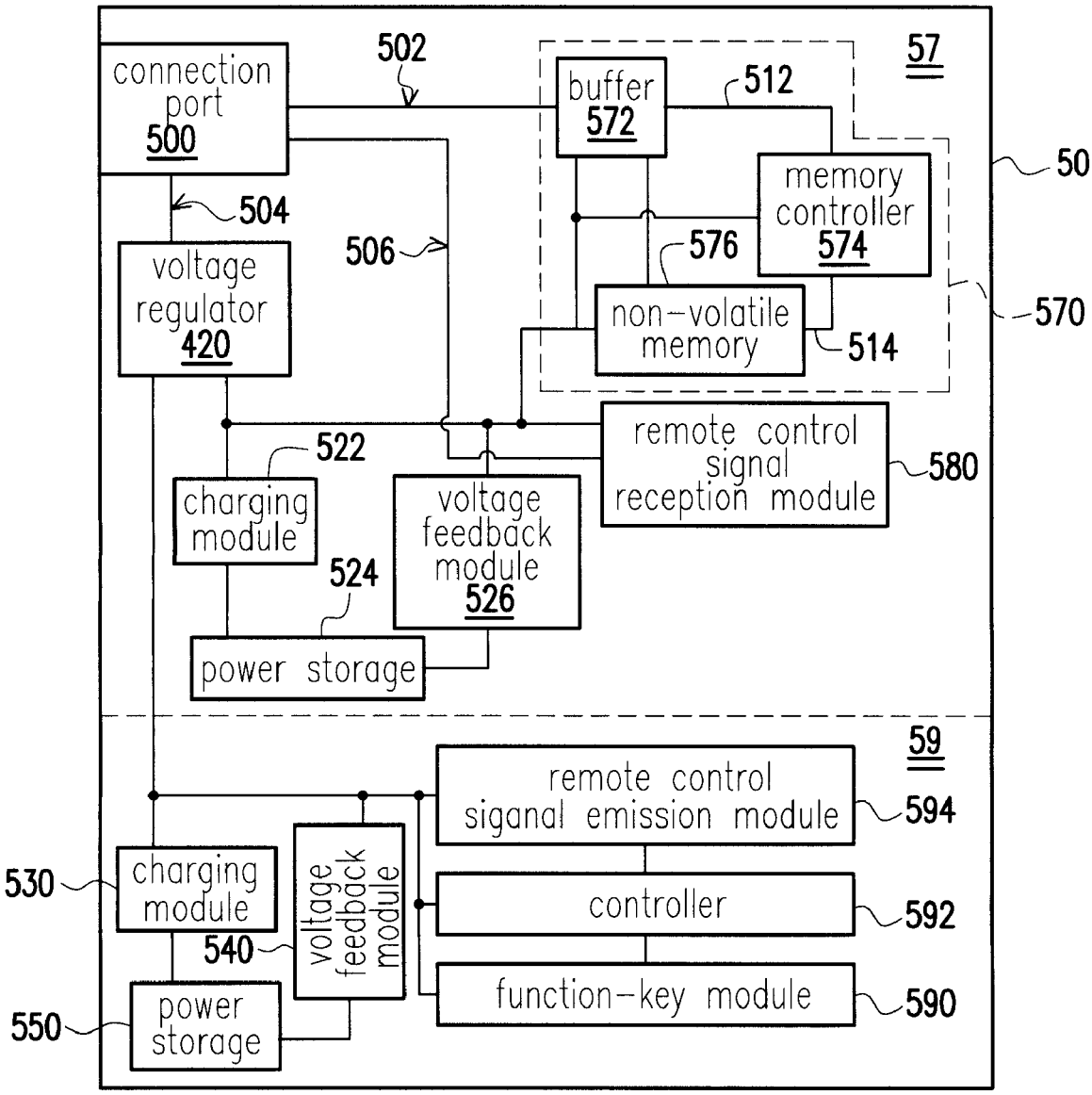
FIG. 5 schematically shows a circuit block diagram of another preferred embodiment according to the present invention.

FIG. 5 schematically shows a circuit block diagram of another preferred embodiment according to the present invention. In the present embodiment, the main part 57 and the remote part 59 comprises the power storage units 524 and 550, respectively. When the host power is lost, the power storage units 524 and 550 provide the power needed to operate the main part 57 and the remote control part 59, respectively. The operation of the power system composed of the charging module 522, the power storage unit 524 and the voltage feedback module 526 is similar to the operation of the power system composed of the charging module 530, the power storage unit 550 and the voltage feedback module 540 or similar to the power system composed by the charging module 430, the power storage unit 450 and the voltage feedback module 440 as shown in FIG. 4, therefore its detailed operation is not described herein. Moreover, as described above, it will be apparent to one of the ordinary skill in the art that the method for controlling the power storage units 524 and 550 to provide the power by using the voltage feedback module 526 and 540 respectively is only one of the methods and does not serve as a limited condition of the present invention.

The power system composed of the charging module 522, the power storage unit 524 and the voltage feedback module 526 inside the main part 57 can provide the power to the memory system 570 for its operation when the host power is lost. If the power system inside the main part 57 mentioned above is modified to the one shown in FIG. 3B, the memory system 570 is able to control providing the power to the power storage unit 524 or not by using the activation control signal as shown in FIG. 3B under a preferred condition. Generally speaking, when the host power operates normally, the power storage unit 524 does not supply power, once it is detected that the host power is suddenly lost, the memory system 570 will ask the power storage unit 524 to supply the power, and the memory controller 574 continuously writes the data cached in the buffer 572 to the non-volatile memory 576 by using the power provided by the power storage unit 524, and also modifies and updates the file description as well as the file allocation table after the writing data operation is completed.

Furthermore, if the firmware embedded in the memory controller 574 detects the voltage variance, after the memory controller 574 writes all data cached in the buffer 572 to the non-volatile memory 576, and modifies and updates the file description as well as the file allocation table, the buffer 572 and the non-volatile memory 576 can be controlled via the control signal line 512 and 514 to stop receiving the power via the power supplying path according to the data that indicates losing the host power detected previously, so as to further achieve the power saving function. Moreover, it will be apparent to one of the ordinary skill in the art that the power saving function also can be achieved by using the activation control signal shown in FIG. 3B to cut the power supplying path of the power storage unit 524 directly.

Figure 6A:
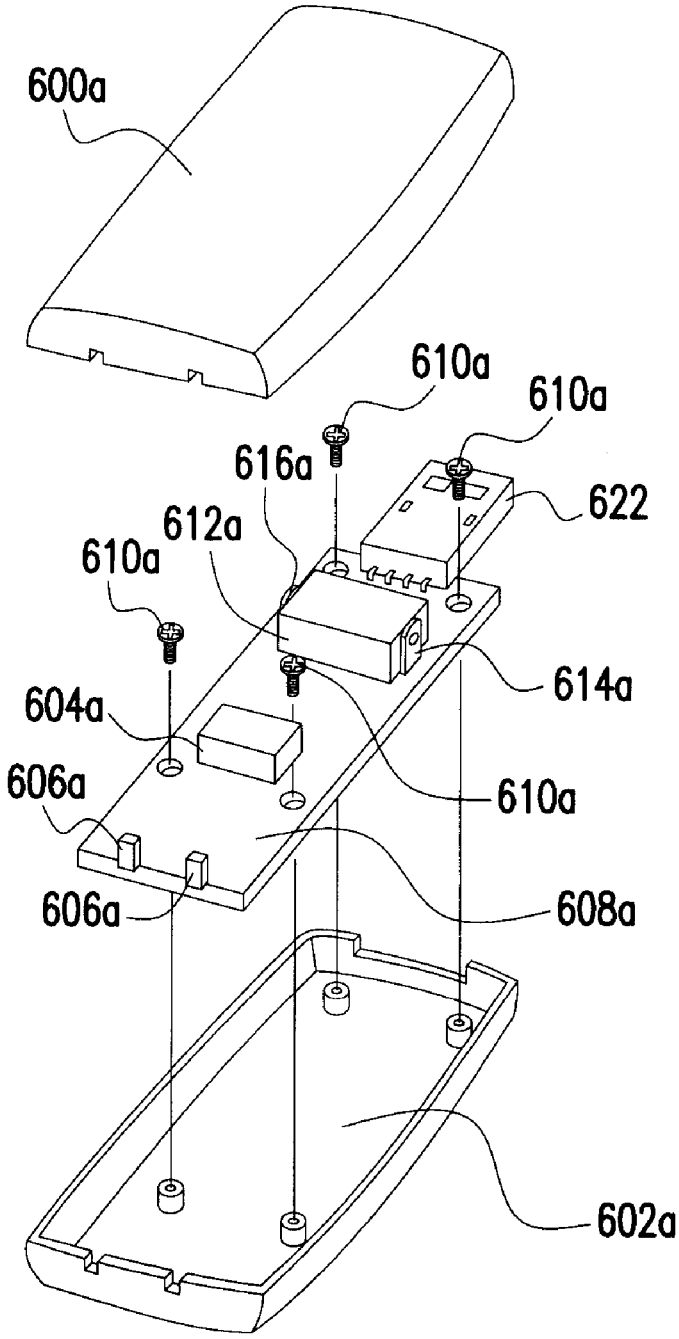
FIG. 6A schematically shows a product part explosion diagram of the main part that embodies a preferred embodiment according to the present invention.
Figure 6B:
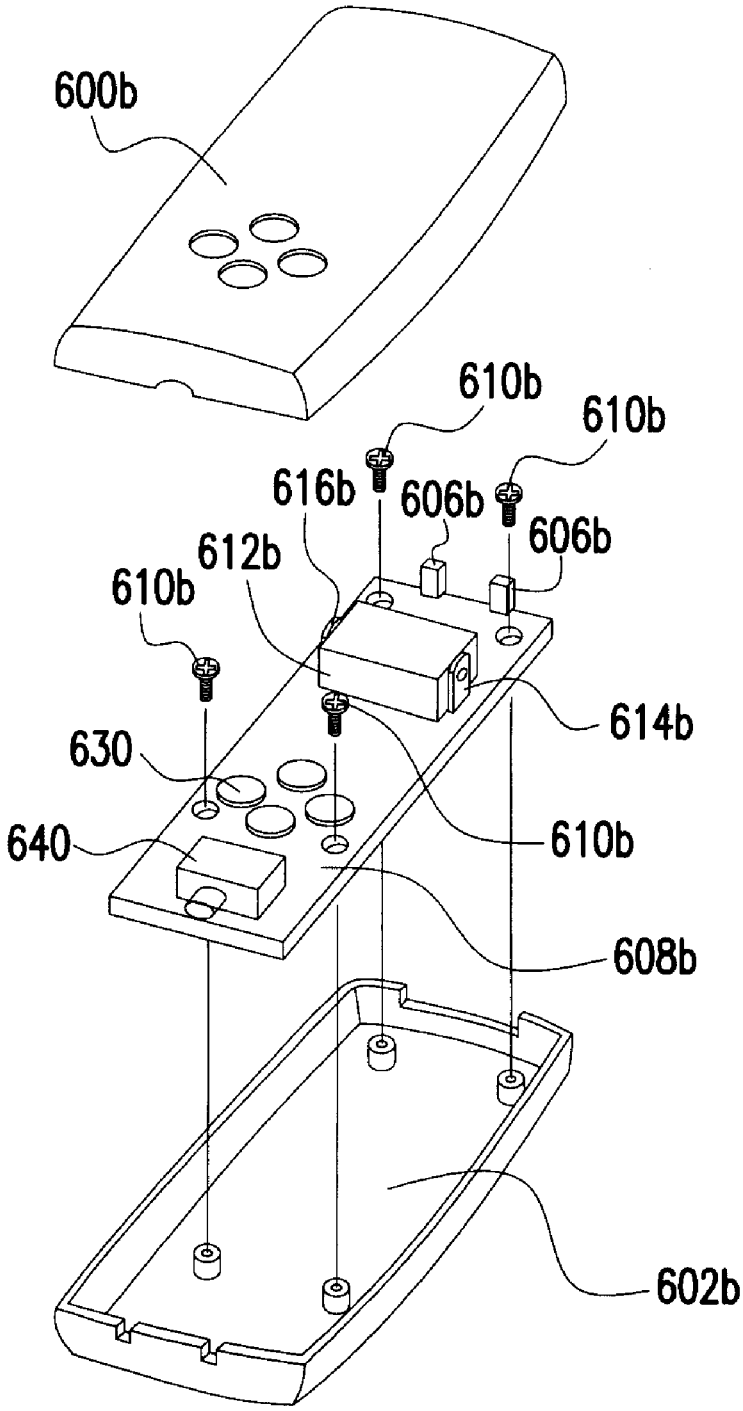
FIG. 6B schematically shows a product part explosion diagram of the remote control part that embodies a preferred embodiment according to the present invention.

FIGS. 6A and 6B schematically show a product part explosion diagram of the main part and the remote control part that embodies a preferred embodiment according to the present invention, respectively. FIG. 6A schematically shows a product part explosion diagram of the main part of a preferred embodiment according to the present invention, and FIG. 6B schematically shows a product part explosion diagram of the remote control part of a preferred embodiment according to the present invention. When these two parts are merged, the charging electrode 606*a* of the main part is coupled to the charging electrode 606*b* of the remote control part, so that the host power can be provided to the remote control part via these charging electrodes 606*a* and 606*b*. Moreover, the remote control signal emitter 640 in FIG. 6B essentially comprises the controller 192 and the remote control signal emission module 194 of FIG. 1, the controller 292 and the remote control signal emission module 294 of FIG. 2, the controller 492 and the remote control signal emission module 494 of FIG. 4, or the controller 592 and the remote control signal emission module 594 of FIG. 5. By assembling these drawings, those who are skilled in the related art can easily implement the non-volatile memory device with wireless control function.

In summary, the present invention is characterized by providing a remote control function so that the computer host operation can be controlled via the external bus connected to the non-volatile memory device. Moreover, a power storage unit is further provided in the non-volatile memory device so as to completely store the data that is not stored completely after the non-volatile memory device is withdrawn from the host.

Although the invention has been described with reference to a particular embodiment thereof, it will be apparent to one of the ordinary skill in the art that modifications to the described embodiment may be made without departing from the spirit of the invention. Accordingly, the scope of the invention will be defined by the attached claims not by the above detailed description.

The invention claimed is:

1. A non-volatile memory device with wireless control function, comprising:

a main part, comprising:

a connection port, electrically coupled to a host, wherein the host provides a data and a host power to the non-volatile memory device with wireless control function via an external bus connected to the connection port;

a memory system, having a non-volatile memory for writing data and receiving data into/from the host via the connection port; and a remote control signal reception module; and a remote control part, comprising:

a function-key module, producing a key signal while being pressed;

a controller, receiving the key signal to produce a corresponding control signal;

a remote control signal emission module, emitting a corresponding remote control signal according to the control signal; and a first power storage unit, storing power for the remote control part operations;

wherein, after receiving the remote control signal, the remote control signal reception module produces a corresponding host control signal, and the host control signal is subsequently transmitted back to the host via the connection port to control the host operations; and the first power storage unit further comprises a voltage feedback module, the voltage feedback module is used to detect whether the host power exists or not, so that the first power storage unit can provide the power to operate the remote control part when the host power is lost.

2. The non-volatile memory device with wireless control function of claim 1, wherein the connection port comprising an interface connection device that is suitable for connecting to one of the universal Serial Bus (USB) interface, the 1394 interface, the RS232 interface, the parallel transmission interface, the PCMCIA interface, the CF interface, the SD interface, the MMC interface and the Memory Stick interface.

3. The non-volatile memory device with wireless control function of claim 1, wherein the remote control part further comprises a charging module, the charging module is used to receive the host power and charge the first power storage unit with the host power.

4. The non-volatile memory device with wireless control function of claim 3, wherein the charging module further comprises a protection module, wherein the protection module is used to protect the first power storage unit from the damage caused by the high voltage.

5. The non-volatile memory device with wireless control function of claim 1, further comprising a voltage regulator, wherein the voltage regulator is used to adjust the host power to a voltage that is suitable for the non-volatile memory device with wireless control function.

6. The non-volatile memory device with wireless control function of claim 1, wherein the first power storage unit is electrically coupled to the connection port so as to receive the host power.

7. The non-volatile memory device with wireless control function of claim 1, wherein the first power storage unit comprises a non-rechargeable battery.

8. The non-volatile memory device with wireless control function of claim 2, wherein the first power storage unit comprises a non-rechargeable battery.

9. The non-volatile memory device with wireless control function of claim 3, wherein the first power storage unit comprises a non-rechargeable battery.

10. The non-volatile memory device with wireless control function of claim 4, wherein the first power storage unit comprises a non-rechargeable battery.

11. The non-volatile memory device with wireless control function of claim 5, wherein the first power storage unit comprises a non-rechargeable battery.

12. The non-volatile memory device with wireless control function of claim 6, wherein the first power storage unit comprises a non-rechargeable battery.

13. The non-volatile memory device with wireless control function of claim 1, wherein the first power storage unit comprises a rechargeable battery.

14. The non-volatile memory device with wireless control function of claim 2, wherein the first power storage unit comprises a rechargeable battery.

15. The non-volatile memory device with wireless control function of claim 4, wherein the first power storage unit comprises a rechargeable battery.

16. The non-volatile memory device with wireless control function of claim 4, wherein the first power storage unit comprises a rechargeable battery.

17. The non-volatile memory device with wireless control function of claim 5, wherein the first power storage unit comprises a rechargeable battery.

18. The non-volatile memory device with wireless control function of claim 6, wherein the first power storage unit comprises a rechargeable battery.

19. The non-volatile memory device with wireless control function of claim 1, wherein the main part further comprises a second power storage unit, the second power storage unit is used to store a power and provide the power to the main part when the host power is lost.

20. The non-volatile memory device with wireless control function of claim 19, wherein the second power storage unit comprises a non-rechargeable battery.

21. The non-volatile memory device with wireless control function of claim 19, wherein the second power storage unit comprises a rechargeable battery.

22. The non-volatile memory device with wireless control function of claim 19, wherein the second power storage unit is electrically coupled to the host power.

23. The non-volatile memory device with wireless control function of claim 22, wherein the second power storage unit comprises a non-rechargeable battery.

24. The non-volatile memory device with wireless control function of claim 22, wherein the second power storage unit comprises a rechargeable battery.

25. A non-volatile memory device with wireless control function, comprising:

a main part, comprising:

a connection port, electrically coupled to a host, wherein the host provides a data and a host power to the non-volatile memory device with wireless control function via an external bus connected to the connection port;

a memory system, having a non-volatile memory for writing data and receiving data into/from the host via the connection port; and a remote control signal reception module; and a remote control part, comprising:

a function-key module, producing a key signal while being pressed;

a controller, receiving the key signal to produce a corresponding control signal;

a remote control signal emission module, emitting a corresponding remote control signal according to the control signal;

a first power storage unit, storing power for the remote control part operations; and a charging module, used to receive the host power and charge the first power storage unit with the host power;

wherein, after receiving the remote control signal, the remote control signal reception module produces a corresponding host control signal, and the host control signal is subsequently transmitted back to the host via the connection port to control the host operations.

26. The non-volatile memory device with wireless control function of claim 25, wherein the charging module further comprises a protection module, wherein the protection module is used to protect the first power storage unit from the damage caused by the high voltage.

27. The non-volatile memory device with wireless control function of claim 25, wherein the first power storage unit comprises a non-rechargeable battery.

28. The non-volatile memory device with wireless control function of claim 25, wherein the first power storage unit comprises a non-rechargeable battery.

29. The non-volatile memory device with wireless control function of claim 25, wherein the first power storage unit comprises a rechargeable battery.

30. The non-volatile memory device with wireless control function of claim 25, wherein the first power storage unit comprises a rechargeable battery.

31. A non-volatile memory device with wireless control function, comprising:

a main part, comprising:

a connection port, electrically coupled to a host, wherein the host provides a data and a host power to the non-volatile memory device with wireless control function via an external bus connected to the connection port;

a memory system, having a non-volatile memory for writing data and receiving data into/from the host via the connection port;

a voltage regulator, used to adjust the host power to a voltage that is suitable for the non-volatile memory device with wireless control function; and a remote control signal reception module; and a remote control part, comprising:

a function-key module, producing a key signal while being pressed;

a controller, receiving the key signal to produce a corresponding control signal;

a remote control signal emission module, emitting a corresponding remote control signal according to the control signal;

a first power storage unit, storing power for the remote control part operations; and a charging module, used to receive the host power and charge the first power storage unit with the host power;

wherein, after receiving the remote control signal, the remote control signal reception module produces a corresponding host control signal, and the host control signal is subsequently transmitted back to the host via the connection port to control the host operations.

32. The non-volatile memory device with wireless control function of claim 31, wherein the first power storage unit comprises a non-rechargeable battery.

33. The non-volatile memory device with wireless control function of claim 31, wherein the first power storage unit comprises a rechargeable battery.

* * * * *